US007229043B2

(12) United States Patent
Pitcher

(10) Patent No.: US 7,229,043 B2
(45) Date of Patent: Jun. 12, 2007

(54) HANGING CABLE SHORTENER ARRANGEMENT

(75) Inventor: David Pitcher, Cambridge, MA (US)

(73) Assignee: Rose Displays, Ltd., Salem, MA (US)

( * ) Notice: Subject to any disclaimer, the term of this patent is extended or adjusted under 35 U.S.C. 154(b) by 263 days.

(21) Appl. No.: 10/838,605

(22) Filed: May 4, 2004

(65) Prior Publication Data

US 2006/0151654 A1 Jul. 13, 2006

Related U.S. Application Data

(63) Continuation-in-part of application No. 10/037,314, filed on Dec. 13, 2001, now abandoned, and a continuation-in-part of application No. 10/036,756, filed on Dec. 31, 2001, now abandoned.

(51) Int. Cl.
*B65H 75/18* (2006.01)

(52) U.S. Cl. ..... 242/407; 242/407.1; 242/405.1; 242/608.2; 242/609.1; 242/388.2

(58) Field of Classification Search ..... 242/388.2, 242/407, 407.1, 405.1, 600, 608, 608.2, 609, 242/609.1, 118.4, 129; 40/601, 603, 604, 40/617, 611.12, 607.14, 606.11
See application file for complete search history.

(56) References Cited

U.S. PATENT DOCUMENTS 2,029,975 A * 2/1936 Winchester ..... 242/129
2,533,495 A * 12/1950 Moffett ..... 242/129
2,824,709 A * 2/1958 Macy ..... 225/44
3,138,309 A * 6/1964 Hulterstrum ..... 225/59
3,601,330 A * 8/1971 Minobe ..... 242/405.1
4,872,622 A * 10/1989 Mansfield ..... 242/405.1
2003/0122022 A1* 7/2003 Pitcher ..... 242/388.1
2003/0122023 A1* 7/2003 Pitcher ..... 242/388.1

FOREIGN PATENT DOCUMENTS

GB 2237003 A * 4/1991

* cited by examiner

*Primary Examiner*—William A. Rivera
*Assistant Examiner*—Sang Kim
(74) *Attorney, Agent, or Firm*—Don Halgren

(57) ABSTRACT

A cable shortener apparatus for permitting the length adjustment of a cable having a certain incompressable diameter. The cable is arranged for supporting a sign carrier from an overhead support. The cable shortener apparatus may be comprised of a duplicate pair of generally rigid annular rings lockably engagable with one another. Each ring may have an inner arcuate hub flange which defines a fixed hub surface for receiving at least one wrap of a support cable. An annular edge on each of the rings is spaced apart from one another when the rings are mated together. The spaced apart annular edges defining a gap no wider than the diameter of the cable being wrapped about the hub of the shortener.

4 Claims, 7 Drawing Sheets

HANGING CABLE SHORTENER ARRANGEMENT

FIELD OF THE INVENTION

This invention relates to cable or line shorteners and more particularly to cable shortener apparatus to permit the ready height adjustment of a ceiling suspended sign by said shortener apparatus arranged at a mid-point of said suspended cable, and is a continuation-in-part application of commonly assigned U.S. patent application Ser. No. 10/037,314 filed Dec. 31, 2001 now abandoned, and U.S. patent application Ser. No. 10/036,756 filed Dec. 31, 2001 now abandoned, which are each incorporated herein by reference in their entirety.

BACKGROUND OF THE INVENTION

Prior Art

Retail commercial establishments often display signs and banners suspended from a ceiling by one or more cables or lines. Often the length of these cables or lines need to be changed depending upon the size of the sign or the height of the ceiling. Replacing these cables or lines, cutting them or crimping loops onto the end can be an expensive and inaccurate way to accomplish such height adjustment.

A number of devices are in the field, which permit such cable length adjustment. These mechanisms, however, appear unduly complicated and hence more expensive and undesirable for large use thereof and more likely to be utilized incorrectly.

U.S. Pat. No. 5,870,845 to Ruderman, et al shows a banner display system which includes a plurality of gears. This makes the system somewhat expensive. U.S. Pat. No. 4,434,570 to Roos shows an advertising support which also utilizes gearing arrangement for adjusting the height of a sign or a banner. A cord stowage apparatus is shown in U.S. Pat. No. 4,802,638 to Burger et al. This cord stowage apparatus comprises a spool having a pair of flexible cup shape members which are arranged to pinch a cable wound around there between. This is a somewhat sophisticated device which would not provide a strong griping tension for supporting a sign nor be able to support any appreciable weight due to the flexible nature of the material.

U.S. Pat. No. 1,272,272 to Kell shows a globe shaped cord adjuster which utilizes a wrapping of a cord around a spherical body for adjusting the length of that cord. This apparatus is overly complex, highly visible, and would result in kinking of the cable. It is also infinitely adjustable meaning that signs may not hang level. U.S. Pat. No. 980,319 to Milam shows a take-up for flexible suspensories utilizing a pair of annular flanges separated by a hub and a pin arrangement for shortening a cable. The cable is held in place around a core by frictional engagement with the parallel sides of the hub. Any release of pressure in the cables (such as the sign being bumped or otherwise being lifted upwardly) will result in the adjuster popping off the cable, allowing the sign to drop several inches. Also, pins as described are not adequate to lock cable in place and any complication with added complexity of pins, it becomes easy for signs to be hung non-level due to small adjustment increments. U.S. Pat. No. 815,422 to Gregory shows and adjustable suspension device utilizing a set of pulleys. U.S. Pat. No. 2,533,731 to Gomberg shows a spool comprised of a rigid pair of different, axially displaceable rims which pinch a length of yarn. The spool dangles and permit the yarn to be pulled from the spool as needed.

The prior art thus discloses a cable and line shortening apparatus which, however, is somewhat complicated to manufacture, thus expensive to produce, and may not satisfactorily grip the cable in a readily sustainable manner to prevent it from sliding over itself between its opposed rims, and thus holding a line or cable at a constant length, the cable being shortened extending out from the spool at two opposed directions.

It is an object of the present invention to provide a cable shortener apparatus which overcomes the disadvantages of the prior art.

It is a further object of the present invention to provide a cable shortener apparatus which is inexpensive to manufacture and easy to assemble.

It is yet a still further object of the present invention to provide a cable shortener apparatus which is readily useable and re-adjustable with minimum complexity thereto.

It is still a further object of the present invention to provide a cable shortener which is minimally obtrusive and which can be readily moved out of the line of sight, particularly after it has been applied to a cable.

It is still another object of the present invention to provide a cable shortener apparatus which does not kink or otherwise mar the cable as by wrapping about sharp bends.

It is another object of the present invention to provide an apparatus which is virtually impossible to hang a sign in a non-level manner.

It is still another object of the present invention to provide a cable apparatus which when put in place, will not release except by a conscious effort.

BRIEF SUMMARY OF THE INVENTION

The present invention comprises a sign cable shortener apparatus for hanging signs and displays from an overhead support such as a ceiling, beam or the like. A cable having an upper end would be attached to a ceiling or overhead support, and the lower end of the cable would be attached to the sign to be supported from that ceiling or overhead support. One or more wraps of cable at a mid-point thereof, would be taken (or untaken) around the cable shortener as described hereinbelow, to shorten or lengthen that cable as necessary.

The cable shortener apparatus of the present invention thus comprises a duplicate pair of rigid annular hubs having a pair of ends. A somewhat rigid annularly-shaped curvilinear flange is disposed at one end of each hub. Each curvilinear flange extends radially outwardly from the respective ends of the hub. Each curvilinear flange has a peripheral lip which is also disposed radially outwardly of the hub. The curvilinear flanges are spaced apart from one another on the hub to define a cable wrap-space between the flanges and about the hub.

The generally rigid peripheral lip of a curvilinear flange on one end of the hub is spaced apart a certain distance from the rigid peripheral lip on the curvilinear flange on the other end of the hub. The certain spaced-apart distance of the peripheral lips is preferably greater than the diameter of the cable (line, drawn plastic filament or wire or the like) being utilized to support a sign from the overhead support or ceiling. The certain spaced-apart distance of the peripheral lips is critically less than the two cable diameters, so as to prevent unintended wrapping (or more likely unwrapping) of the cable past itself in the gap, that is, the certain spaced-apart distance between the opposed peripheral lips of the flanges. It would thus take a certain manual effort to slightly bend the lip and thus squeezably move/slide one cable past itself in the gap between the peripheral lips of the flanges to unwrap and thus adjust the length of that cable during its support of a sign. This effort would be easily accomplished by a store employee where such a sign is to be hung.

The cable shortener apparatus may be readily adjusted, location-wise on the extended cable itself merely by sliding the shortener apparatus one way or the other on that cable or line, the cable or line being slid about the hub of the shortener apparatus as the shortener apparatus is being moved, with no winding of the cable/line squeezingly past or over itself between the peripheral lips being necessary.

One preferred embodiment of the construction of the shortener apparatus comprises a first annular ring and second annular ring, each identical to one another. The first (and second) annular ring comprises an annular housing having a curved outermost wall from a circular outermost edge to a generally circular innermost edge.

Each ring has an axis of rotation which is perpendicular to the plane of the annular housing. Each ring has a pair of arcuate locking flanges extending axially away from the inner edge of the curved side of the annular housing. Each arcuate locking flange is preferably an arcuate segment of about ninety degrees. Each arcuate locking segment is spaced apart from one another on the inner edge by about ninety degrees. Each arcuate locking flange has an axial length equal to the axial length of the opposed ring into which it will mate. One joined together, the rim segments define a shortener apparatus having an axis of rotation and a hub of fixed length.

Each annular ring has arcuate hub flange extending an axial distance away from the curved wall of the annular ring. Each annular hub flange comprises an arcuate segment of about ninety degrees, and has an outermost peripheral surface which defines an (outer) hub or drum for winding receipt of a cable thereabout. Each arcuate hub flange on each ring is disposed between adjacent arcuate locking flanges. Each adjacent locking flange has a radially outermost peripheral surface which is dimensioned and spaced so as to be received radially inwardly of each arcuate hub flange.

In the assembly of a sign cable shortener apparatus, a first ring is mated with a second ring, each of those rings being out of phase with one another preferably by ninety degrees, so as to permit the radially outer peripheral surface of the arcuate locking flange to slide radially inwardly of the arcuate hub flange of the other ring of the sign cable shortener apparatus.

When the two rings are mated together, the inner curvilinear peripheral wall of each ring and the circumferentially adjacent surfaces of the arcuate hub flanges defines a cable wrap area of fixed length in which a sign hanging cable may be wrapped circumferentially therearound. The outermost peripheral lips of each ring are generally rigid, as is each ring, and defines between them a gap or a width which is no greater than the diameter of the cable which may be wrapped about the arcuate hub flanges.

To shorten or lengthen a sign hanging cable to correct the height adjustment of a sign suspended from a ceiling or uppermost support location, the store employee would wrap or unwrap one or more turns of cable about the arcuate hub flange arrangement. The cable leading to a sign and to a ceiling support would include at least one wrap about the arcuate hub flanges, and that cable would be disposed (exit) tangentially with respect to those arcuate hub flanges. The cable would not by itself become unwrapped from the cable shortener apparatus by itself, because the width of the gap between the opposed rigid flanges of each opposed ring less than double the diameter of the cable. It would take manipulative effort by a store employee to pull one cable frictionally (squeezably) against its other end so as to unwrap or wrap the cable around the hub and thereby adjust the length of that sign hanging cable.

The invention thus comprises a cable shortener apparatus for permitting the length adjustment of a cable supporting a sign carrier from an overhead support. The cable has a certain non-compressable constant diameter. The apparatus comprises a twin pair of rigid annular rings lockably engagable with one another, each ring having an inner arcuate hub flange which defines a non-changeable hub surface of fixed axial length for receiving at least one wrap of a support cable. An annular edge is arranged on each of the rings, and are spaced apart from one another when the rings are mated together, the spaced apart annular edges defining an annular gap no wider than the diameter of the cable. Each of the rigid annular rings has at least one arcuate locking flange for securing the rings to one another. The arcuate locking flange and the arcuate hub flange are radially adjacent one another.

Each of the annular rings may have at least two arcuate locking flanges, opposed to one another on an inner edge of each of the annular rings. Each of the annular rings may have at least two inner arcuate hub flanges, opposed to one another on an inner edge of each of the annular rings. The annular rings may have an annular inner wall which defines a cable wrap area with the inner hub flanges, about which the cable may be wrapped. The inner hub flanges on each of the rings may be spaced apart from one another by 90 degrees. The arcuate locking flanges on each of the rings may be spaced apart from one another by 90 degrees. It is to be noted that a different number of locking flanges and arcuate hub flanges than stated above, may be utilized on the rings to permit the mating of the rings and still accomplish the invention.

The invention also includes a method of adjusting a sign supporting cable holding a sign carrier from an overhead support, comprising the steps of mating together a pair of rigid annular rings, each of the rings having an arcuate hub portion, and a rigid annular edge defining an inner and an outer wall member of each of the rings, spacing the rigid annular edges apart by no more than the diameter of the cable, wrapping the cable about the hub portion of the annular rings to change the length of the cable supporting the sign carrier.

The method may include forming an arcuate inner locking flange on each of the rings to permit the rings to lock onto one another, rotating at least one of the rings about an axis of rotation so that the rings are out of phase with one another by at least 90 degrees when they are mated together, and spacing the inner locking flange on one of the generally rigid annular rings radially adjacent the arcuate hub flange of the other of the generally rigid annular rings when the generally rigid annular rings are mated together.

Thus, what has been shown as a unique sign cable shortener adjustment apparatus which permits a sign hanging cable to be readily, safely and inexpensively adjusted by a simple and inexpensive to manufacture and assemble sign cable adjustment apparatus in a very efficient manner.

The invention thus comprises a cable shortener apparatus for permitting the length adjustment of a cable supporting a sign carrier from an overhead support. The cable has a certain non-compressable diameter. The apparatus comprises a pair of generally rigid annular rings lockably engagable with one another, each ring having an inner arcuate hub flange which defines a hub surface of fixed axial length for receiving at least one wrap of a support cable, an annular outermost edge on each of the rings, spaced apart from one another when the rings are mated together, the spaced apart annular edges defining a gap less than twice said diameter of the cable. Each of the generally rigid annular rings has at least one arcuate locking flange for securing the rings to one another. The arcuate locking flange and the arcuate hub flange are radially adjacent one another. Each of the annular rings has at least two arcuate locking flanges, opposed to one another on an inner edge of each of the annular rings. Each of the annular rings has at least two inner arcuate hub flanges, opposed to one another on an inner edge of each of the annular rings. The annular rings have an annular inner wall which defines a cable wrap area of toroidal shape with the inner hub flanges, about which the cable is wrapped. The inner hub flanges on each of th3e rings are spaced apart from one another by at least 90 degrees. The arcuate locking flanges on each of the rings are spaced apart from one another by at least 90 degrees. Each of the annular rings are a duplicate of one another.

The invention also comprises a method of adjusting a sign supporting cable holding a sign carrier from an overhead support, the cable having a certain diameter, the method comprising one or more of the following steps: attaching an upper end of the cable to the overhead support; attaching a lower end of the cable to the sign; forming an annular hub with a first end and a second end; arranging a generally rigid, radially outwardly extending flange on each end of the hub, each of said radially outwardly extending flanges having an outer peripheral lip spaced apart from the outer peripheral lip of the other of the flanges by a distance less than twice the certain cable diameter; wrapping or unwrapping an entering or upper end of the cable about the hub and extending an exiting or lower end of the cable between the radially outwardly extending flange, the entering end and the exiting end of the cable being 180 degrees out of phase with one another as in a straight line so as to permit the adjustment of the length of the cable supporting the sign carrier; forming the hub and radially outwardly extending flanges by mating together a pair of rigid annular rings, each of the rings having an arcuate hub portion and a generally rigid annular edge defining an inner and an outer wall member of each of the rings; spacing the generally rigid annular edges apart by less than twice the certain diameter of the cable; wrapping the cable about the hub portion of the annular rings to change the length of the cable supporting the sign carrier; forming an arcuate inner locking flange on each of the rings to permit the rings to lock onto one another; rotating at least one of the rings about an axis of rotation so that the rings are out of phase with one another by at least 90 degrees when they are mated together; spacing the inner locking flange on one of the rigid annular rings radially adjacent the arcuate hub flange of the other of the rigid annular rings when the rigid annular rings are mated together.

The invention also comprises a cable shortener apparatus for permitting the length adjustment of an incompressable cable supporting a sign carrier from an overhead support, the cable having a certain diameter, the apparatus comprising: a pair of generally rigid annular rings having each having an outer peripheral lip and an inner axially directed lip; a short annular drum disposed between the generally rigid annular rings, the rings and the drum lockably engaged with one another, each of the axially directed lips of the rings and drum defining an inner hub of fixed axial length for receiving at least one wrap of a support cable, each of the spaced apart peripheral lips defining a gap less than twice the diameter of the cable. The annular rings, which are duplicates of one another, and the drum, are press fit together.

The invention also comprises a cable shortener apparatus for permitting the length adjustment of a cable supporting a sign carrier from an overhead support, the cable having a certain incompressable diameter, the apparatus comprising: an annular generally U-shaped channel assembly formed into generally toroidal shaped volume having a hub of fixed axial length and an open outermost peripheral gap defined by a pair of radially outwardly directed axially adjacent walls. An outermost peripheral lip of each of the walls are heat and/or pressure formable toward on another to create a narrow generally rigidly spaced apart relationship of the outermost peripheral lips for squeezing release of a cable pulled therepast. The spaced apart relationship is less than twice the certain diameter of the cable. The cable is preferably a flexible strand of material and is about one thirty-second of an inch in diameter.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENT

Figure 1:
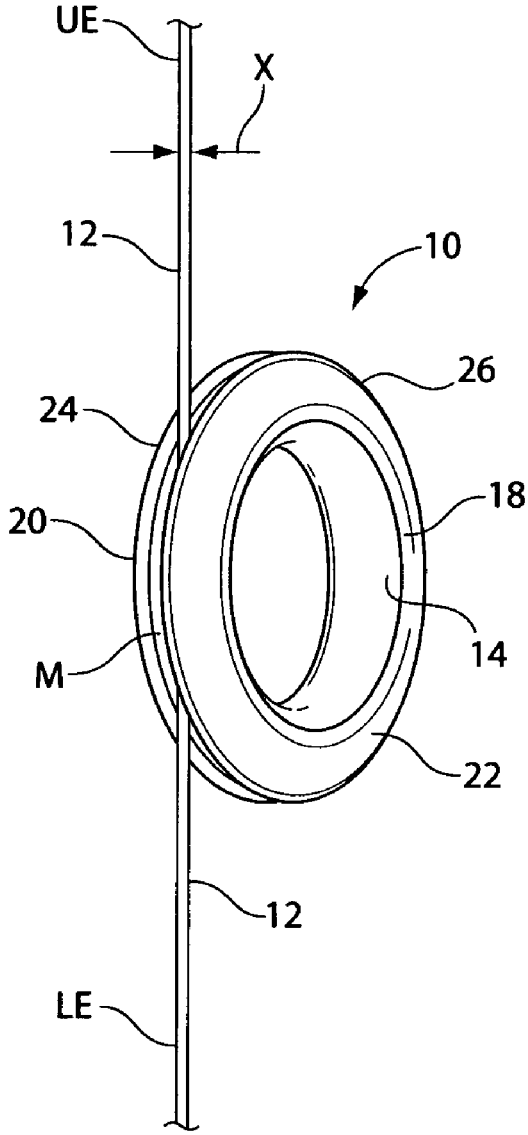
FIG. 1 is a perspective view of a cable shortener apparatus of the present invention with a cable wrapped about its hub.
Figure 1A:
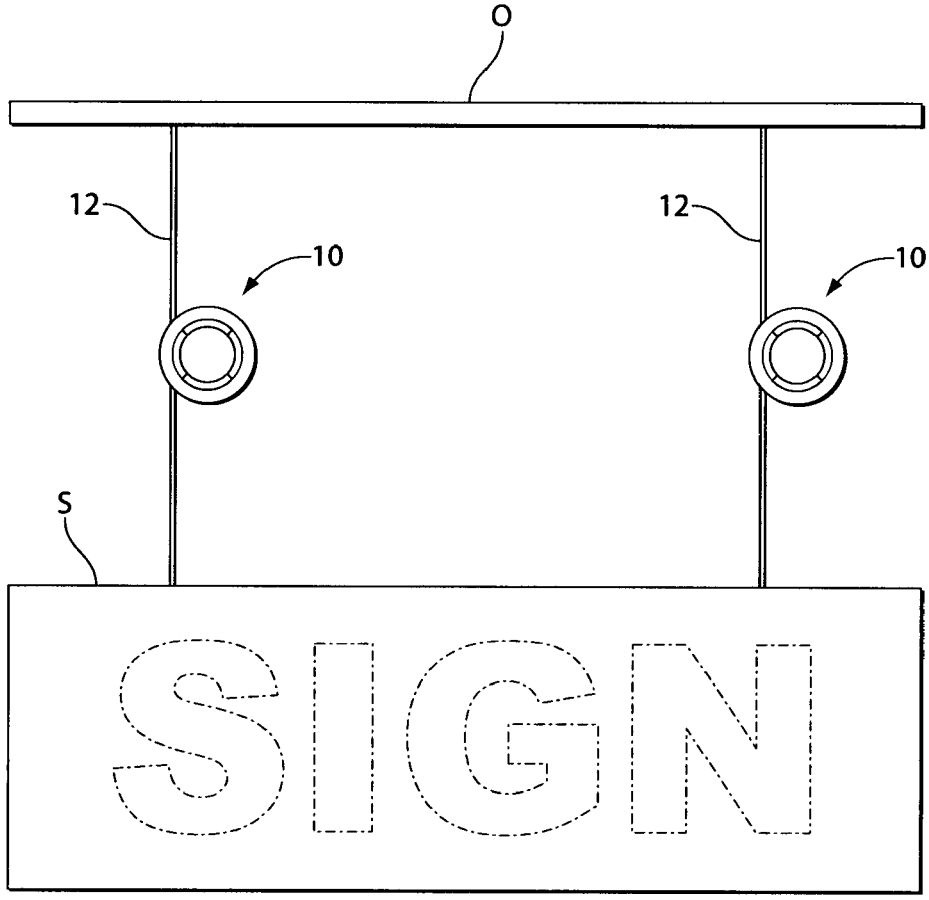
FIG. 1*a* is a schematic representation of a cable shortener apparatus supporting a sign from a ceiling.

Referring now to the drawings in detail, and particularly to FIGS. 1 and 1(*a*), there is shown the present invention which comprises a sign cable shortener apparatus 10 for hanging signs "S" and displays from an overhead support "O", as shown in FIG. 1*a*, such support comprising a ceiling, beam or the like. A non-compressable cable 12 having an upper end UE would be attached to a ceiling or overhead support "O", and the lower end LE of the cable 12 would be 180 degrees out of phase with the upper end UE of the cable 12, and attached to the sign to be supported from that ceiling or overhead support. One or more wraps of cable would be taken (or untaken) around the cable shortener as described hereinbelow, to shorten or lengthen that cable 12 as necessary.

The cable shortener apparatus 10 of the present invention as embodied in FIG. 1 thus comprises, after assembly, a rigid annular hub 14 of fixed axial length, having a pair of ends 16 and 18. A generally rigid annularly-shaped curvilinear flange 20 and 22 is disposed at each end 16 and 18 of the hub 14, as may be seen in FIG. 1. Each curvilinear flange 20 and 22 extends radially outwardly from the respective ends 16 and 18 of the hub 14. Each curvilinear flange 20 and 22 has a generally rigid but somewhat yieldable peripheral lip 24 and 26 respectively, which are also disposed radially outwardly of the hub 14. The curvilinear flanges 20 and 22 are spaced apart from one another on the hub 14 to define a cable wrap-space "M" between the flanges 20 and 22 and about the hub 14.

The generally rigid peripheral lip 24 of a curvilinear flange 20 on one end 16 of the hub 14 is spaced apart a certain distance "D" from the generally rigid peripheral lip 26 on the curvilinear flange 22 on the other end 18 of the hub 14. The certain spaced-apart distance "D" of the peripheral lips 24 and 26 is preferably greater than the diameter "X" of the cable 12 (line, drawn plastic filament or wire or the like) being utilized to support a sign "S" from the overhead support or ceiling "O". The certain spaced-apart distance "D" of the peripheral lips 24 and 26 is critically less than the two cable diameters "X", so as to prevent unintended wrapping (or more likely unwrapping) of the cable 12 past itself in the gap, that is, the certain spaced-apart distance "D" between the opposed peripheral lips 24 and 26 of the flanges 20 and 22. It would thus take a certain manual effort to squeezably move/slide the cable 12 past itself in the gap ("D") between the slightly yieldable peripheral lips 24 and 26 of the flanges 20 and 22 to unwrap and thus adjust the length of that cable 12 during its support of a sign. This effort would be easily accomplished by a store employee where such a sign were hung.

The cable shortener apparatus 10 may be readily adjusted, location wise on some mid-point the extended cable 12 itself merely by sliding the shortener apparatus 10 one way or the other on that cable 12 or line, the cable or line being slid about the hub of the shortener apparatus 10 as the shortener apparatus 10 is being moved, with no winding of the cable/line 12 squeezingly past or over itself between the peripheral lips 24 and 26 being necessary.

Referring further to the drawings in detail, and again to FIG. 1*a*, et seq., there is shown a preferred construction embodiment of the present invention which comprises a sign cable shortener apparatus 10 for hanging signs and displays "S" from an overhead support such as a ceiling, beam "O" or the like at a mid-point of an incompressable cable, wire or line 12.

Figure 2:
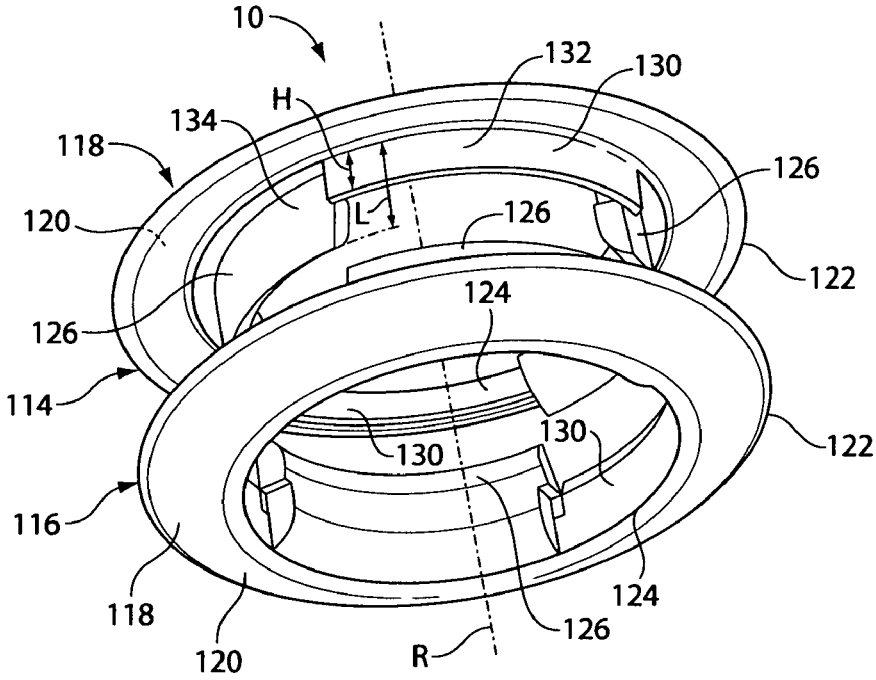
FIG. 2 is an exploded view of a pair of opposed rings comprising the present invention in a perspective view thereof.
Figure 3:
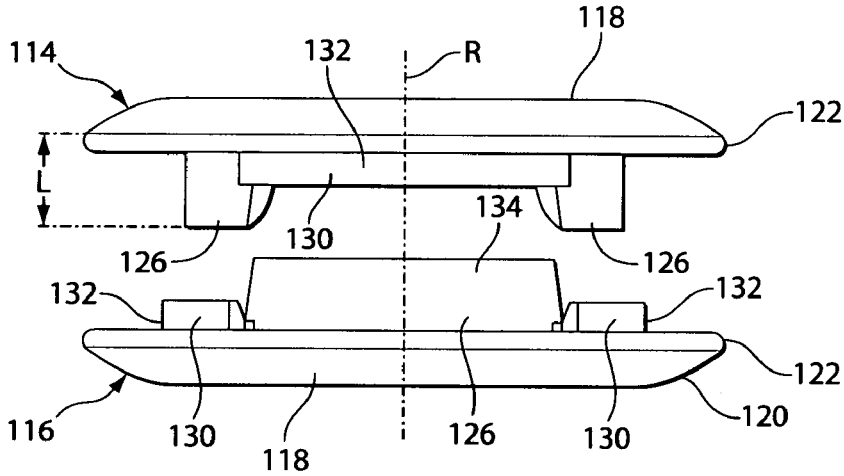
FIG. 3 is an exploded view of the rings in a side elevational view shown in FIG. 2.

An embodiment of the shortener apparatus 10 construction is shown in FIG. 2 through FIG. 9(*b*) which comprises a first annular ring 114 and a second annular ring 116, as is shown best in FIG. 2, each ring 114 and 116 being identical to one another. The first (and second) annular ring 114 and 116 each comprises an annular housing 118 having a curved outermost wall 120 from a circular outermost edge 122 to a generally circular innermost edge 124.

Each ring 114 and 116 has an axis of rotation "R" which is perpendicular to the plane of the annular housing 118. Each ring 114 and 116 has a pair of arcuate locking flanges 126 extending axially away from the inner edge 124 of the curved side 120 of the annular housing 118. Each arcuate locking flange 126 is preferably an arcuate segment of about ninety degrees. Each arcuate locking flange 126 may be spaced apart from one another on the inner edge 124 of the housing 118 by about ninety degrees. Each arcuate locking flange 126 has an axial length "L" equal to the axial length of the opposed ring into which it will mate, as may be seen in FIGS. 2, 3 and 6.

Each annular ring 114 and 116 has arcuate hub flange 130 extending an axial distance "H" away from the curved wall 120 of the annular rings 114 and 116. Each annular hub flange 130 comprises an arcuate segment of preferably about ninety degrees, and has an outermost peripheral surface 132 which defines an outer hub or drum for winding receipt of a cable 112 thereabout. Each arcuate hub flange 130 on each ring 114 and 116 is disposed between adjacent arcuate locking flanges 126. Each adjacent locking flange 126 has a radially outermost peripheral surface 134 which is dimensioned and spaced so as to be received radially inwardly of each arcuate hub flange 130, as may be seen in FIGS. 2, 3 and 6.

Figure 4:
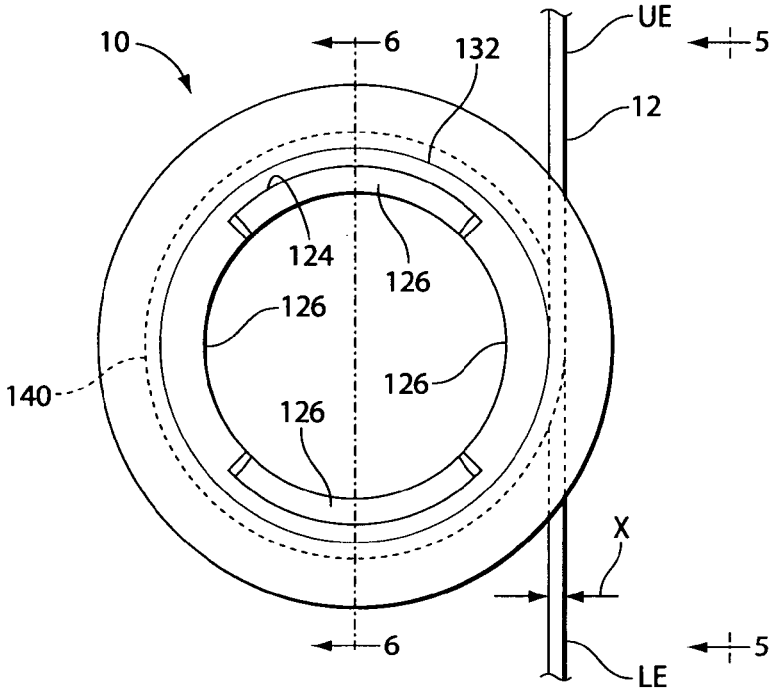
FIG. 4 is a plan view of the cable shortener apparatus of the present invention.
Figure 5:
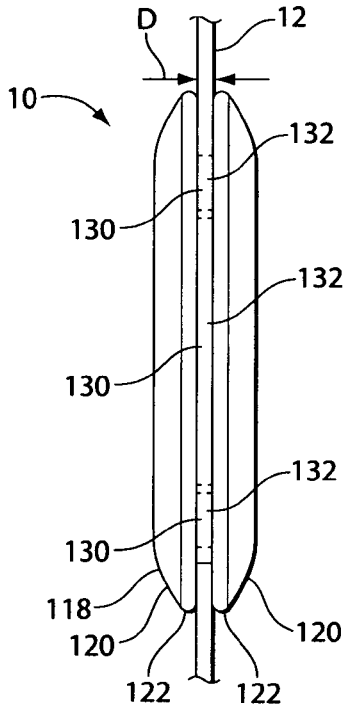
FIG. 5 is a view taken along the lines 5—5 of FIG. 4.
Figure 6:
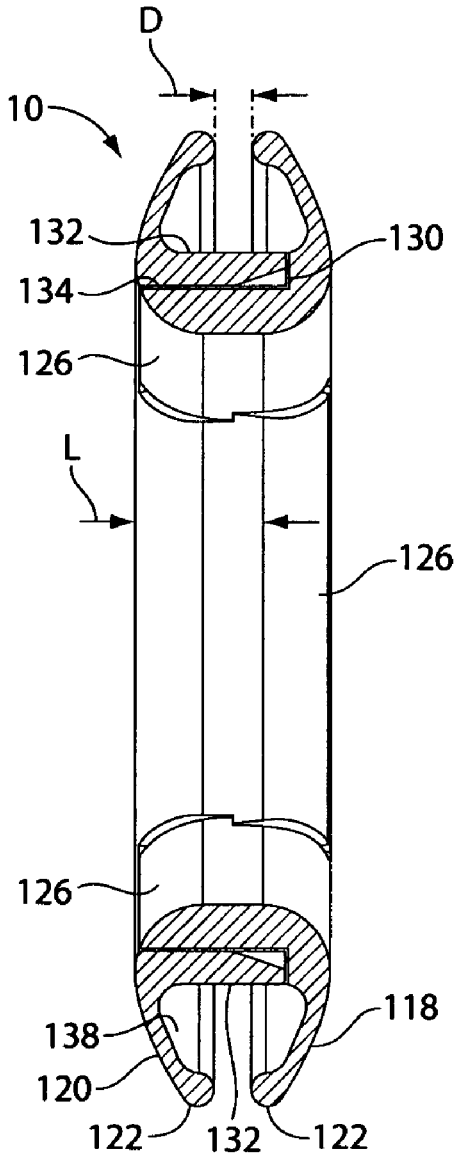
FIG. 6 is a view taken along the lines 6—6 of FIG. 4.

In the assembly of a sign cable shortener apparatus 10, a first ring 114 is mated with its twin, a second ring 116, as may be seen in FIGS. 4, 5 and 6, each of those rings 114 and 116 being circumferentially out of phase with one another in this embodiment having only pairs of flanges, by about ninety degrees, so as to permit the radially outer peripheral surface 134 of the arcuate locking flange 126 of one ring (i.e. 114) to slide radially inwardly of the arcuate hub flange 130 of the other ring (i.e. 16) of the sign cable shortener apparatus 10.

When the two rings 114 and 116 are mated together, the inner curvilinear peripheral wall 138 of each ring and the circumferentially adjacent surfaces 132 of the arcuate hub flanges 130 defines a fixed volume cable wrap area 140 in which a sign hanging cable 12 may be wrapped circumferentially therearound. The outermost peripheral lips or edges 122 of each ring 114 and 116 are generally rigid, as is each ring 114 and 116, and defines between them a gap or a width "D" which is critically less than twice the diameter "X" of the cable 12 which may be wrapped about the arcuate hub flanges 130. It is to be noted that the number of locking flanges and arcuate flanges may be changed according to design considerations, and is within the breadth of this invention.

In order to shorten or lengthen a sign hanging cable 12 to correct the height adjustment of a sign "S" suspended from a ceiling or uppermost support location "O", the store employee would wrap or unwrap one or more turns of cable 12 about the contiguous arcuate hub flanges 130 arrangement. The cable 12 leading to a sign "S" and to a ceiling support "O" would include at least one wrap of cable 12 about the arcuate hub flanges 130, and that cable 12 would be disposed (exit) tangentially with respect to those arcuate hub flanges 130, as may be seen in FIG. 4, the cable 12 exiting the hub 180 degrees out of phase with respect to the other end of the cable entering the hub. The cable 12 would not become unwrapped from the cable shortener apparatus 10 by itself, because the width "D" of the gap between the opposed generally rigid flanges or edges 22 of each opposed ring 114 and 116 is to be less than twice the diameter of the cable 12. It would take manipulative effort by a store employee to pull one incompressable cable 12 frictionally against its other end so as to unwrap or wrap the cable 12 around the hub and thereby adjust the length of that sign hanging cable.

Figure 7A:
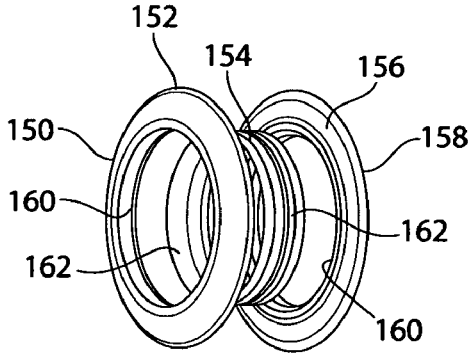
FIG. 7(*a*) and FIG. 7(*b*) shows a further embodiment of the construction of the cable shortener apparatus of the present invention.
Figure 7B:
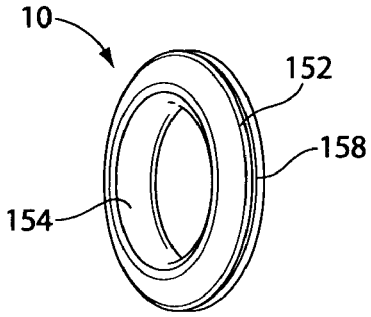

A further embodiment of the construction and assembly of the cable shortener 10 of the present invention is shown in FIG. 7(*a*) wherein a first ring 150 having a first annular peripheral lip 152, a short drum 154 of short axial length, and a second ring 156 having an annular peripheral lip 158 are shown in an exploded depiction. The drum 154 and the first and second rings 150 and 156 are mated together in a male-female relationship to form a generally rigid cable shortener 10 in this embodiment by a press fit, or by a bonding of radially adjacent annular surfaces 160 and 162 to define the cable shortener 10 similar to that shown in FIG. 1, which when assembled in this particular embodiment, is shown in perspective view in FIG. 7(*b*) with the larger annular cable wrap receiving chamber and a narrow gap between the peripheral lips 152 and 158 of a dimension which is less than twice the diameter of a cable/line to be wrapped about the drum 154, to deny easy overlap and undesired unwinding of a cable from the cable shortener.

Figure 8A:
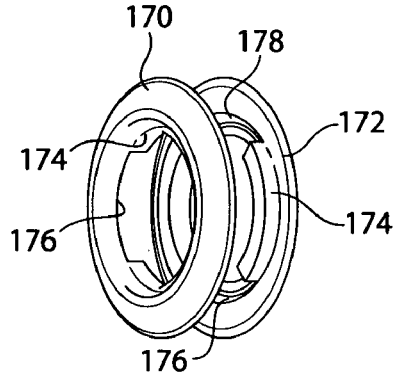
FIG. 8(*a*) and FIG. 8(*b*) shows another further embodiment of the construction of the cable shortener apparatus of the present invention.
Figure 8B:
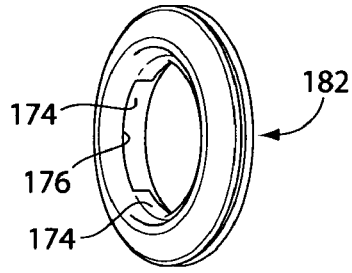

FIG. 8(*a*) another assembly embodiment of the cable shortener ring 10, wherein a first ring 170 and a second ring 172 each have an inner peripheral lip 174 are presented in an exploded perspective view. Each ring 170 and 172 has a pair of arc segments 176 and 178 extending in one axial direction from that peripheral lip 174, as well as an arcuate gap 180 between peripherally adjacent arc segments 176 and 178. To construct a cable shortener 10 in this embodiment, the rings 170 and 172 are arranged in a lip-to-lip orientation with the rings 170 and 172 in an exemplary 90 degrees out of phase with one another so that an arcuate segment 174 of one ring 170 or 172 mates with an arcuate gap 176 or 178 of its mating ring 172 or 170. Such a mating of gaps 176 and 178 and segments 174 may then be sonic welded or bonded at their respective touching surfaces to form the rigid cable shortener 182 which is similar to the cable shortener 10 shown in FIG. 1.

Figure 9A:
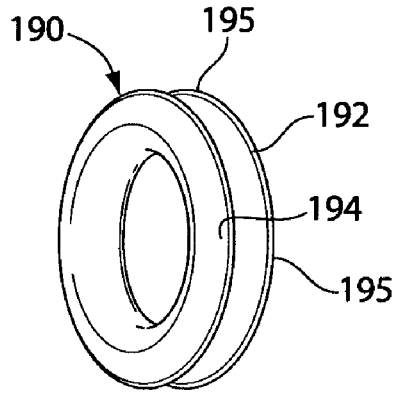
FIG. 9(*a*) and FIG. 9(*b*) shows still another embodiment of the construction of the cable shortener apparatus of the present invention.
Figure 9B:
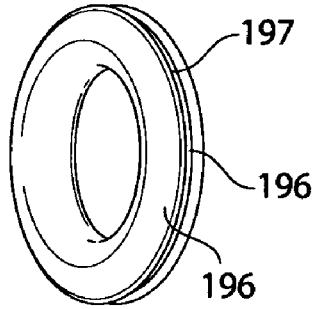

FIG. 9(*a*) shows yet a further embodiment of the construction process of the cable shortener 10 of the present invention. An annular generally U-shaped channel 190 is molded or formed of a plastic material as a generally toroidal shape with an open outermost peripheral gap 192 defined by a pair of radially outwardly directed walls 194. After such molding operation, the outermost peripheral lips 196 of the walls 194 may be heat and/or pressure formed toward on another to create the narrow rigidly spaced apart relationship of those outermost peripheral lips 196, a distance apart as recited in the aforementioned embodiments, of less than twice the diameter of a cable wrapped about the hub or channel of the cable shortener, the assembled construction in this embodiment being shown in FIG. 9(*b*).

Thus, what has been shown as a unique sign cable shortener adjustment apparatus which permits a sign hanging cable to be readily, safely and inexpensively adjusted by a simple and inexpensive to manufacture and assemble sign cable adjustment apparatus in a very efficient manner. The cable shortener being shown as constructable by several techniques which permit the unique annular cable wrap receiving toroid with a narrow peripheral cable entry/unwind gap between adjacent lips thus facilitating the adjustment of the length of a sign hanging cable. The cable or line of the present invention is preferably made of an incompressable strand(s) of plastic, metal or cotton-like construction (and may preferably be about for example about one thirty-second of an inch 'more or less' in diameter).

I claim:

1. A method of adjusting a non-compressible sign supporting cable holding a sign carrier from an overhead support, said cable having a certain diameter, said method comprising:

attaching an upper end of said non-compressible cable to said overhead support;

attaching a lower end of said non-compressible cable to said sign;

forming an annular hub with a first end and a second end;

arranging a generally rigid, radially outwardly extending flange on each end of said hub, each of said radially outwardly extending flanges having an outer peripheral yieldable lip spaced apart from said outer peripheral lip of the other of said flanges by a distance less than twice said certain cable diameter;

wrapping or unwrapping an entering or upper end of said cable about said hub and extending an exiting or lower end of said cable exiting from said hub between said radially outwardly extending flange, said entering end and said exiting end of said cable being 180 degrees out of phase with one another as in a straight line so as to permit the simple adjustment of the length of said cable supporting said sign carrier.

2. The method as recited in claim 1, including:

forming said hub and radially outwardly extending flanges by mating together a pair of rigid annular rings, each of said rings having an arcuate hub portion and a generally rigid annular edge defining an inner and an outer wall member of each of said rings;

spacing said rigid annular edges with said yieldable lips thereon apart by less than twice said certain diameter of said cable;

wrapping said cable about said hub portion of said annular rings to change the length of said cable supporting said sign carrier.

3. The method as recited in claim 2, including:

forming an arcuate inner locking flange on each of said rings to permit said rings to lock onto one another.

4. The method as recited in claim 1, including:

spacing said inner locking flange on one of said rigid annular rings radially adjacent said arcuate hub flange of the other of said rigid annular rings when said rigid annular rings are mated together.

* * * * *